US010246979B2

(12) United States Patent
Donald et al.

(10) Patent No.: US 10,246,979 B2
(45) Date of Patent: Apr. 2, 2019

(54) REMOTE STEAM GENERATION AND WATER-HYDROCARBON SEPARATION IN STEAM-ASSISTED GRAVITY DRAINAGE OPERATIONS

(71) Applicant: Suncor Energy Inc., Calgary (CA)

(72) Inventors: Andrew Donald, Calgary (CA); Todd Stewart Pugsley, Priddis (CA); Gary L. Bunio, Calgary (CA); Ian Donald Gates, Calgary (CA)

(73) Assignee: Suncor Energy Inc., Calgary (CA)

( * ) Notice: Subject to any disclaimer, the term of this patent is extended or adjusted under 35 U.S.C. 154(b) by 91 days.

(21) Appl. No.: 14/671,104

(22) Filed: Mar. 27, 2015

(65) Prior Publication Data

US 2015/0275637 A1 Oct. 1, 2015

(30) Foreign Application Priority Data

Mar. 28, 2014 (CA) ..... 2847881

(51) Int. Cl.
*E21B 43/40* (2006.01)
*E21B 43/24* (2006.01)
*E21B 43/16* (2006.01)

(52) U.S. Cl.
CPC ..... *E21B 43/2408* (2013.01); *E21B 43/164* (2013.01); *E21B 43/40* (2013.01)

(58) Field of Classification Search
CPC ..... Y02P 90/70; E21B 43/2408; E21B 43/164
See application file for complete search history.

(56) References Cited

U.S. PATENT DOCUMENTS 4,322,603 A 3/1982 Bright
4,488,598 A 12/1984 Duerksen
(Continued)

FOREIGN PATENT DOCUMENTS

CA 1166531 A 5/1984
CA 2815144 A1 11/2013
(Continued)

OTHER PUBLICATIONS

I.D. Gates, G. Bunio, J. Wang, B. Robinson, Impact of Carbon Dioxide Co-Injection on the Performance of SAGD, World Heavy Oil Congress, Alberta 2011, 14 pages.

*Primary Examiner* — Silvana C Runyan
(74) *Attorney, Agent, or Firm* — Brinks Gilson & Lione

(57) ABSTRACT

A Steam-Assisted Gravity Drainage (SAGD) method for recovering hydrocarbons from a reservoir can include generating steam and $CO_2$ from feedwater, fuel and oxygen; transferring a steam-$CO_2$ mixture comprising at least a portion of the steam and at least a portion of the $CO_2$, to a proximate SAGD injection well; injecting the steam-$CO_2$ mixture into the SAGD injection well; obtaining produced fluids from a SAGD production well underlying the SAGD injection well; transferring the produced fluids for separation proximate to the SAGD production well; separating the produced fluids into a produced gas and a produced emulsion; transferring the produced emulsion for separation proximate to the SAGD production well; separating the produced emulsion to obtain a produced hydrocarbon-containing component and produced water; supplying at least a portion of the produced water as at least part of the feedwater; and supplying the produced hydrocarbon-containing component to a central processing facility.

35 Claims, 13 Drawing Sheets

(56) References Cited

U.S. PATENT DOCUMENTS

| | | | | |
|---|---|---|---|---|
| 5,085,275 | A | 2/1992 | Gondouin | |
| 6,205,289 | B1 | 3/2001 | Kobro | |
| 6,454,010 | B1 | 9/2002 | Thomas et al. | |
| 7,628,204 | B2 | 12/2009 | Iqbal et al. | |
| 8,167,041 | B2 | 5/2012 | Chiesa et al. | |
| 2008/0078552 | A1 | 4/2008 | Donnelly et al. | |
| 2008/0257543 | A1 | 10/2008 | De Francesco et al. | |
| 2008/0289821 | A1* | 11/2008 | Betzer Tsilevich | E21B 43/2406 166/272.3 |
| 2008/0289822 | A1* | 11/2008 | Betzer Tsilevich | E21B 43/24 166/272.3 |
| 2010/0147516 | A1* | 6/2010 | Betzer-Zilevitch | B03D 1/02 166/272.6 |
| 2010/0200231 | A1 | 8/2010 | Minnich | |
| 2010/0224363 | A1 | 9/2010 | Anderson et al. | |
| 2010/0224370 | A1 | 9/2010 | Donnelly et al. | |
| 2011/0005749 | A1* | 1/2011 | Curole | B01D 61/027 166/272.3 |
| 2011/0089013 | A1* | 4/2011 | Sakurai | B01D 17/0205 201/2 |
| 2011/0259586 | A1 | 10/2011 | Latimer et al. | |
| 2012/0000642 | A1 | 1/2012 | Betzer Tsilevich | |
| 2012/0073810 | A1* | 3/2012 | Macadam | E21B 43/305 166/272.3 |
| 2012/0325470 | A1* | 12/2012 | Gupta | E21B 43/2406 166/272.3 |
| 2013/0068458 | A1 | 3/2013 | MacAdam et al. | |
| 2014/0060825 | A1* | 3/2014 | MacAdam | F01K 21/04 166/272.3 |

FOREIGN PATENT DOCUMENTS

| | | | |
|---|---|---|---|
| RU | 2149258 | C1 | 5/2000 |
| WO | 2012122041 | A2 | 9/2012 |

* cited by examiner

REMOTE STEAM GENERATION AND WATER-HYDROCARBON SEPARATION IN STEAM-ASSISTED GRAVITY DRAINAGE OPERATIONS

CROSS REFERENCE TO RELATED APPLICATIONS

This application claims priority under 35 U.S.C. § 119 to Canadian application Serial No. 2,847,881, filed on Mar. 28, 2014. The entirety of application 2,847,881 is hereby incorporated by reference herein.

TECHNICAL FIELD

The general technical field relates to in situ hydrocarbon recovery operations, and more particularly to steam-assisted hydrocarbon recovery operations.

BACKGROUND

Many in situ techniques exist for recovering hydrocarbons from subsurface reservoirs. One technique is called Steam-Assisted Gravity Drainage (SAGD) and employs a pair of vertically-spaced horizontal wells drilled into a reservoir. High-pressure steam is continuously injected into the overlying injection well to heat the hydrocarbons and reduce viscosity, causing the heated hydrocarbons and condensed water to drain under the force of gravity into the underlying production well. Multiple SAGD well pairs typically extend in parallel relation to each other from a well pad.

In SAGD operations, steam generation and water treatment are typically performed in a central processing facility, while the well pairs are located in remote hydrocarbon recovery areas that include at least one well pad and several SAGD wells. Production fluids recovered from the production wells are also pumped from each remote hydrocarbon recovery area to the central processing facility for treatment. Production fluids are typically water-hydrocarbon emulsions and can also include vapours. The pipeline infrastructure between the central processing facility and remote hydrocarbon recovery areas is thus designed and operated to accommodate large flow rates of steam and production fluid. High pressure steam pipelines running over long distances can be costly to install and maintain, and high flow rate production fluid pipelines require large pipes and pumps to enable transportation of the hydrocarbons and water.

In the central processing facility, there are various units for treating the production fluid in order to recover the hydrocarbons as well as treat the produced water phase to enable reuse in steam generation. Typical steam generators, such as Once-Through Steam Generators (OTSG) and drum boilers, can be large and expensive and can be shared by more than one remote hydrocarbon recovery area and/or multiple well pads.

Generation of steam at the central processing facility and transportation of steam and production fluids between the central processing facility and remote hydrocarbon recovery areas can lead to various inefficiencies and costs.

Various challenges still exist in the area of SAGD hydrocarbon recovery, steam generation as well as water treatment and recycling.

SUMMARY

In some implementations, there is provided a Steam-Assisted Gravity Drainage (SAGD) method for recovering hydrocarbons from a reservoir, the method including: generating steam and $CO_2$ from feedwater, fuel and oxygen; transferring a steam-$CO_2$ mixture comprising at least a portion of the steam and at least a portion of the $CO_2$, to a proximate SAGD injection well; injecting the steam-$CO_2$ mixture into the SAGD injection well; obtaining produced fluids from a SAGD production well underlying the SAGD injection well; transferring the produced fluids for separation proximate to the SAGD production well; separating the produced fluids to obtain a produced gas and a produced emulsion; transferring the produced emulsion for separation proximate to the SAGD production well; separating the produced emulsion to obtain a produced hydrocarbon-containing component and produced water; supplying at least a portion of the produced water as at least part of the feedwater; and supplying the produced hydrocarbon-containing component to a central processing facility.

In some implementations, transferring the steam-$CO_2$ mixture includes transferring all of the $CO_2$.

In some implementations, the steam-$CO_2$ mixture comprises between about 1 wt % to about 12 wt % of $CO_2$.

In some implementations, the feedwater further comprises makeup water.

In some implementations, the concentration of the makeup water in the feedwater is about 0 wt % to about 90 wt %.

In some implementations, the concentration of the makeup water in the feedwater is about 0 wt % to about 20 wt %.

In some implementations, the concentration of the makeup water in the feedwater is about 0 wt % to about 10 wt % of the feedwater.

In some implementations, the concentration of the makeup water in the feedwater is about 0 wt % to about 5 wt % of the feedwater.

In some implementations, the method further includes: controlling contaminants in the feedwater by regulating relative proportions of the makeup water and the produced water.

In some implementations, there is provided a Steam-Assisted Gravity Drainage (SAGD) system for recovering hydrocarbons from a reservoir, the system including: a central processing facility; and a remote hydrocarbon recovery facility connected to the central processing facility by a supply line, the remote hydrocarbon recovery facility including: a steam generator for receiving feedwater and generating a steam-based mixture therefrom; a well pad supporting a SAGD well pair comprising: a SAGD injection well in fluid communication with the steam generator to receive the steam-based mixture; and a SAGD production well for recovering produced fluids from the reservoir; a water-hydrocarbon separator in fluid communication with the SAGD production well to receive the produced fluids and produce a produced water component and a produced hydrocarbon-containing component, the supply line being in fluid communication with the separator to transport the produced hydrocarbon-containing component to the central processing facility.

In some implementations, the steam generator comprises a Direct-Fired Steam Generator (DFSG).

In some implementations, the steam-based mixture comprises a steam-$CO_2$ mixture that includes steam and combustion gases produced by the DFSG.

In some implementations, the system further includes: a gas-emulsion separator in fluid communication with the SAGD production well to receive the produced fluids and produce a produced gas and gas-depleted produced fluids, the water-hydrocarbon separator being configured to receive the gas-depleted produced fluids.

In some implementations, the system further includes a produced gas line for transporting the produced gas from the gas-emulsion separator to the central processing facility.

In some implementations, the system further includes: a water recycle line for recycling at least a portion of the produced water from the water-hydrocarbon separator as at least part of the feedwater to the DFSG.

In some implementations, recycling at least a portion of the produced water includes recycling all of the produced water.

In some implementations, the feedwater further comprises makeup water.

In some implementations, the system further includes: a makeup water line for supplying the makeup water to the steam generator from a water source.

In some implementations, the water source comprises a water tank located at the remote hydrocarbon recovery facility.

In some implementations, the water source comprises a water treatment facility.

In some implementations, the water source comprises a natural water source.

In some implementations, the system further includes: a fuel line for supplying fuel from the central processing facility to the steam generator.

In some implementations, the system further includes: an oxygen supply assembly for supplying an oxygen-containing gas to the steam generator for combustion.

In some implementations, the water-hydrocarbon separator comprises a free water knockout drum.

In some implementations, the water-hydrocarbon separator further comprises a treater.

In some implementations, the water-hydrocarbon separator further comprises a skim tank.

In some implementations, the water-hydrocarbon separator further comprises an induced floatation unit.

In some implementations, the water-hydrocarbon separator further comprises a walnut shell filtering unit.

In some implementations, the water-hydrocarbon separator further comprises a slop-oil tank.

In some implementations, the system further includes: a diluent line to supply a diluent to the produced fluids to produce diluted produced fluids that are separated in the water-hydrocarbon separator.

In some implementations, the diluent line is connected upstream of the water-hydrocarbon separator.

In some implementations, the diluent line is in fluid communication with the central processing facility to receive the diluent therefrom.

In some implementations, the diluent line is in fluid communication with a diluent tank or diluent truck located at the remote hydrocarbon recovery facility.

In some implementations, the hydrocarbon-containing component is a hydrocarbon mixture containing an amount of water.

In some implementations, the amount of water in the hydrocarbon mixture is of up to about 10 wt %.

In some implementations, the central processing facility comprises a second water-hydrocarbon separator for receiving the hydrocarbon mixture and separating the hydrocarbon mixture into treated water and produced hydrocarbons.

In some implementations, the system further includes: a second recycle line for conveying at least a portion of the treated water back to the remote hydrocarbon recovery facility to recycle at least a portion of the treated water as part of the feedwater to the steam generator.

In some implementations, there is provided a method for generating steam for a Steam-Assisted Gravity Drainage (SAGD) operation comprising a SAGD well pair that includes a SAGD injection well overlying a SAGD production well extending into the reservoir from a well pad, the method including: supplying makeup water from a distant central processing facility to the well pad; and proximate to the well pad: separating produced fluids recovered from the SAGD production well into produced water and a produced hydrocarbon-containing component, and generating steam from feedwater comprising at least a portion of the produced water and at least a portion of the makeup water.

In some implementations, the concentration of the makeup water in the feedwater is about 0 wt % to about 90 wt %.

In some implementations, the concentration of the makeup water in the feedwater is about 0 wt % to about 20 wt %.

In some implementations, the concentration of the makeup water in the feedwater is about 0 wt % to about 10 wt % of the feedwater.

In some implementations, the concentration of the makeup water in the feedwater is about 0 wt % to about 5 wt % of the feedwater.

In some implementations, the step of generating steam is performed in a Direct-Fired Steam Generator (DFSG) and comprises producing an injection gas mixture of steam and $CO_2$ for injection into the SAGD injection well.

In some implementations, the method further comprises: controlling a content of the $CO_2$ in the injection gas mixture.

In some implementations, the content of the $CO_2$ in the injection gas mixture is maintained at or below about 12 wt %.

In some implementations, the content of the $CO_2$ in the gas mixture is maintained at or below about 4 wt %.

In some implementations, the content of the $CO_2$ in the injection gas mixture is maintained sufficiently low such that the produced fluids include at most about 12 wt % $CO_2$.

In some implementations, the content of the $CO_2$ in the injection gas mixture is maintained sufficiently low such that the SAGD operation has an oil rate, a cumulative oil recovery, and/or a steam-to-oil ratio (SOR) substantially similar to no $CO_2$ injection.

In some implementations, the method further includes: controlling contaminants in the feedwater by regulating relative proportions of the makeup water and the produced water.

In some implementations, there is provided a method for recovering hydrocarbons in a Steam-Assisted Gravity Drainage (SAGD) operation the SAGD operation comprising a SAGD well pair that includes a SAGD injection well overlying a SAGD production well extending into the reservoir from a well pad, the method comprising: proximate to the well pad: recovering produced fluids from the SAGD production well; separating the produced fluids into produced water and a produced hydrocarbon-containing component; generating steam from feedwater comprising the produced water; and injecting the steam into the SAGD injection well; and supplying the produced hydrocarbon-containing component to a distant central processing facility.

In some implementations, the method further includes: proximate to the well pad: separating the produced fluids recovered from the SAGD production well into a produced gas and a produced emulsion; and separating the produced emulsion into the produced water and the produced hydrocarbon-containing component.

In some implementations, the method further includes: supplying the produced gas to the distant central processing facility.

In some implementations, the feedwater further comprises makeup water at least partially obtained from the distant central processing facility.

In some implementations, there is provided a method for recovering hydrocarbons from a reservoir, including: generating steam from feedwater; transferring the steam to a proximate SAGD injection well, injecting the steam mixture into the SAGD injection well; obtaining produced fluids from a SAGD production well underlying the SAGD injection well; transferring the produced fluids for separation proximate to the SAGD production well; separating the produced fluids to obtain a produced gas and a produced emulsion; transferring the produced emulsion for separation proximate to the SAGD production well; separating the produced emulsion to obtain a produced hydrocarbon-containing component and produced water; supplying at least a portion of the produced water as at least part of the feedwater; and supplying the produced hydrocarbon-containing component to a central processing facility.

In some implementations, the feedwater further comprises makeup water transported from a water source.

In some implementations, the water source is a water tank located at the remote hydrocarbon recovery facility.

In some implementations, the water source is a water treatment facility.

In some implementations, the water source is a natural water source.

In some implementations, the step of generating steam further includes generating an injection gas mixture comprising steam and CO2 using a Direct-Fired Steam Generator (DFSG).

It should be understood that various implementations of the methods and systems described herein can include various further features described herein.

DETAILED DESCRIPTION

Various techniques are described for recovering oil from a reservoir in a SAGD operation using remote steam generation and water-hydrocarbon separation. Instead of being located and operated solely at a central processing facility, steam generators and water-hydrocarbon separators can be located and operated directly at corresponding remote hydrocarbon recovery facilities located at a distance from the central processing facility. The water-hydrocarbon separators can be used to separate water from production fluids and the produced water can be recycled as feedwater to the steam generators. In some implementations, remote steam generation and water-hydrocarbon separation can reduce heat loss, pipeline and pump sizes, and energy losses.

In some implementations, the steam generators located and operated at the remote hydrocarbon recovery facilities include Direct-Fired Steam Generators (DFSG). A DFSG is a steam generator that generates steam by directly contacting feedwater with a hot combustion gas. It is to be noted that a DFSG can also be referred to as a Direct-Contact Steam Generator (DCSG). The hot combustion gas is produced using fuel, such as natural gas, and an oxidizing gas, such as air or an oxygen-enriched gas mixture. Depending on the oxidizing gas and fuel that are used, the combustion gas can include carbon dioxide ($CO_2$) as well as other gases such as carbon monoxide (CO), nitrogen based compounds such as nitric oxide (NO) and nitrogen dioxide ($NO_2$) and/or sulfur based compounds such as sulfur oxides. Typically, a DFSG includes a fuel inlet for receiving fuel supply, an oxidizing gas inlet for receiving oxygen supply and a water inlet for receiving feedwater supply. The fuel and oxidizing gas can be premixed prior to reaching a burner and a flame is generated in a combustion chamber. Feedwater is typically not allowed to come in direct contact with the flame and can be run down the combustion chamber in jacketed pipes and into an evaporation chamber. The hot combustion gas evaporates the feedwater in the evaporation chamber, generating an outlet stream including steam and combustion gas.

Using DFSGs at the remote hydrocarbon recovery facilities is facilitated due to their small size and scalability. The $CO_2$ included in the combustion gas can be co-injected with the steam directly into the SAGD injection well. Co-injection of the $CO_2$ with the steam can reduce the need to separate and dispose of the $CO_2$ by other means.

In some implementations, a water-hydrocarbon separation unit at each of the remote hydrocarbon recovery facilities allows for at least some of the produced water to be directly recycled back to the DFSG as feedwater for steam generation. This recycling of produced water is facilitated by the DFSG's ability to operate effectively with lower feedwater quality, in some scenarios with feedwater quality that is considered unacceptable for use in an OTSG or drum boiler.

Figure 1:
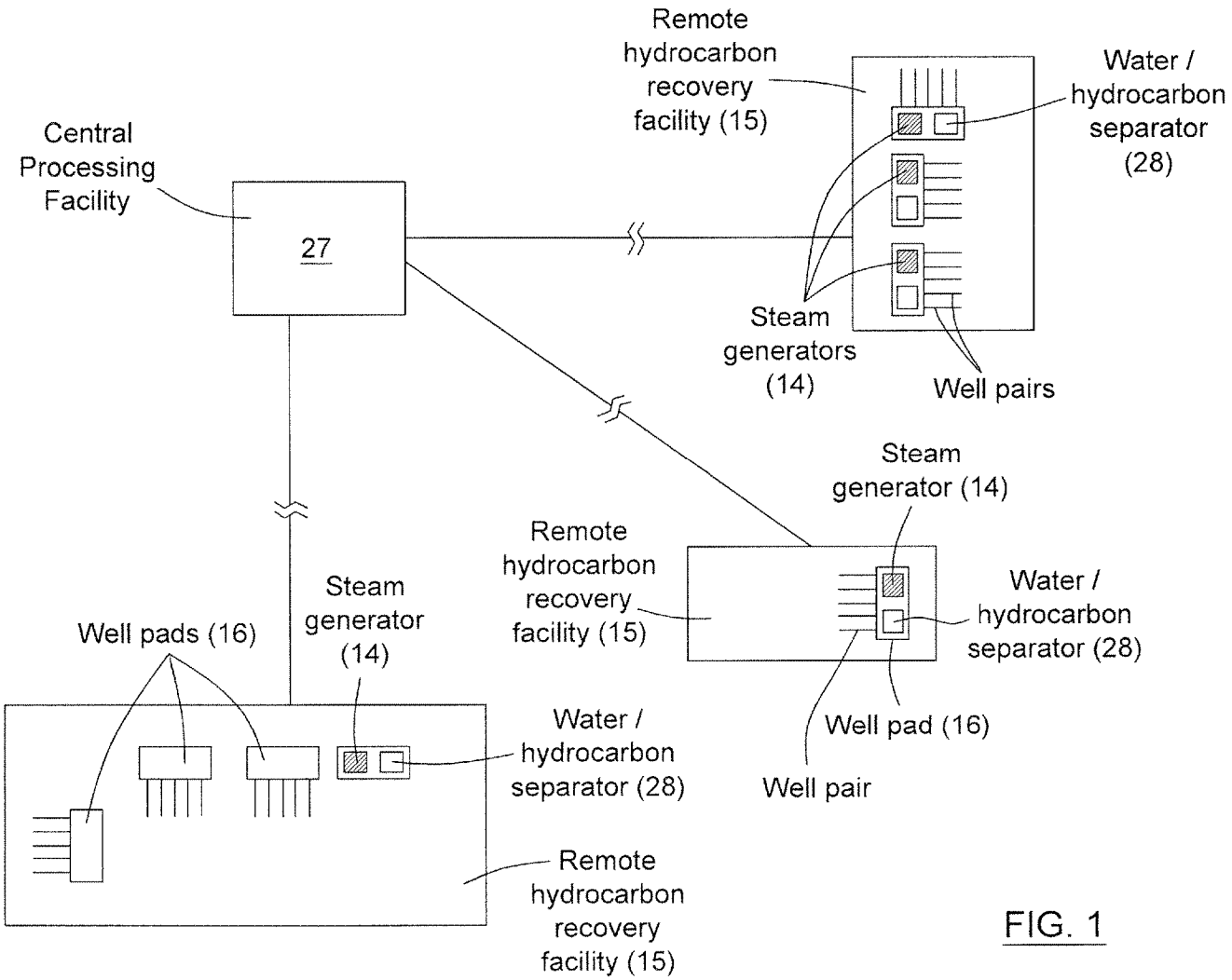
FIG. 1 is a top view schematic of a SAGD system with steam generation and water recycling at remote hydrocarbon recovery facilities.

Hydrocarbon Recovery with DFSG Located Proximate to Well Pad and Water Recycling Referring to FIG. 1, the SAGD operation includes at least one remote hydrocarbon recovery facility located at a remote distance from a central processing facility supporting the SAGD operations. Each of the at least one remote hydrocarbon recovery facilities can include at least one steam generator, at least one well pad for supporting the SAGD wells and associated equipment and piping, SAGD well pairs extending from the well pad into the reservoir, and at least one water-hydrocarbon separator.

It should be understood that "located at a distance" means that the hydrocarbon recovery facilities are not located in proximity to the central processing facility. It is typical for the central processing facility to be located several kilometers from the remote hydrocarbon recovery facilities being supported. It should also be understood that a "remote hydrocarbon recovery facility" is a facility that is located in a geographical area and includes at least one well pad with corresponding SAGD well pairs, at least one steam generator and at least one water-hydrocarbon separator. The steam generator and the water-hydrocarbon separator are installed in proximity to the at least one well pad. In this context, it should be understood that "in proximity" means that the steam generator and water-hydrocarbon separator are located on the well pads for supplying steam to the wells of the same well pad and treating production fluids retrieved from the same well pad; on an adjacent well pad of the same hydrocarbon recovery facility; or in the general area as the well pads of the given hydrocarbon recovery facility and remote from the central processing facility. Some examples of "in proximity" could mean that the steam generator and water-hydrocarbon separator are located within about 200 meters, about 100 meters, about 50 meters, or even about 20 meters of the well pads.

Figure 2:
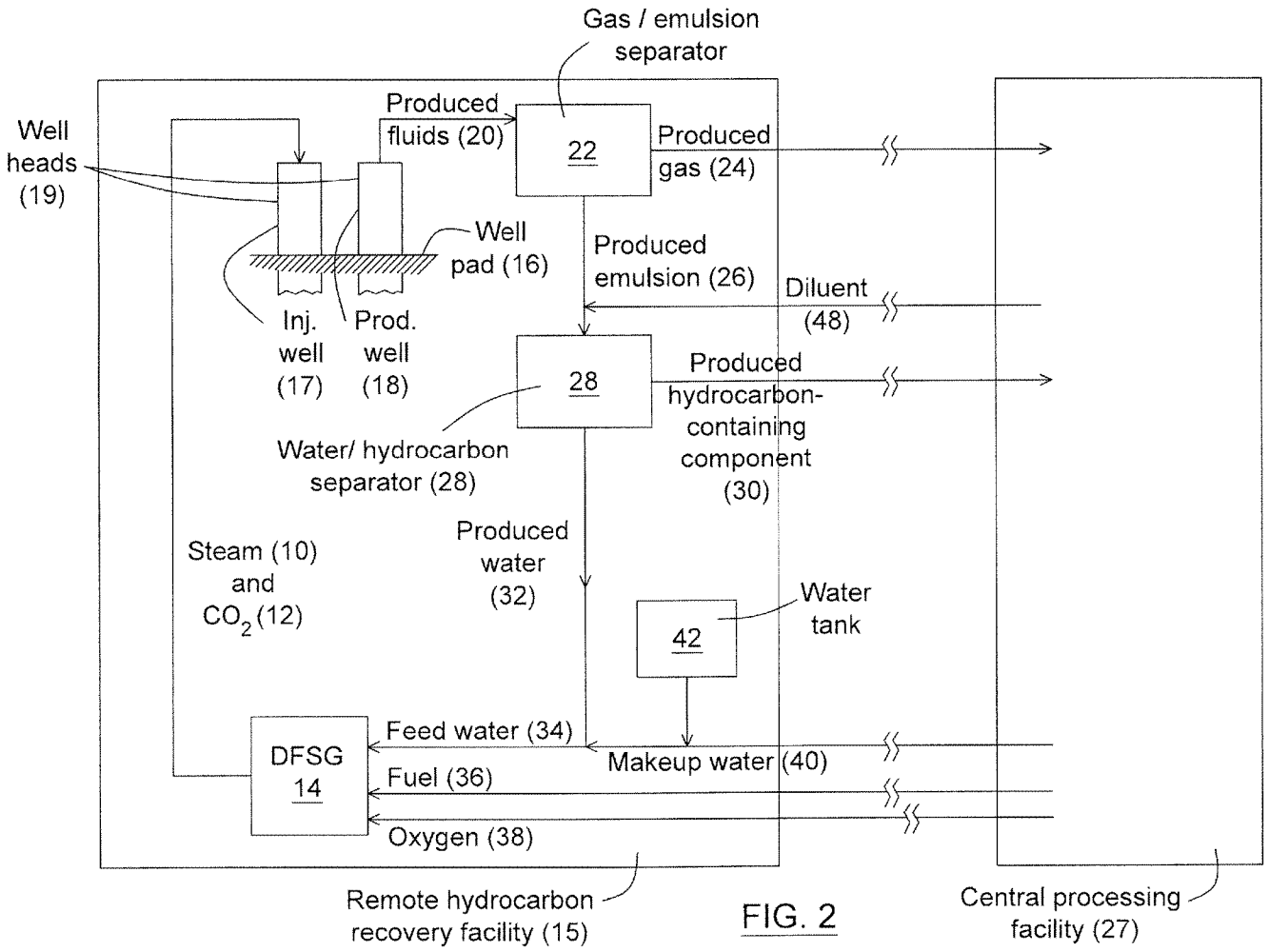
FIG. 2 is a process flow diagram of a SAGD operation with steam generation and water recycling at a remote hydrocarbon recovery facility.

Referring to FIG. 2, in some implementations, steam 10 and $CO_2$ 12 are generated using a DFSG 14 located at a remote hydrocarbon recovery facility 15, in proximity to a well pad 16 in a SAGD operation. The well pad 16 supports a SAGD injection well 17 and a SAGD production well 18. A steam-$CO_2$ mixture, including at least part of the steam 10 and at least a portion of the $CO_2$ 12, is injected into the injection well 17 at an injection rate, an injection temperature and an injection pressure. The steam-$CO_2$ mixture can include or consist of the output stream of the DFSG 14, and can thus include other combustion gases. In some situations, a small steam line (not shown) can convey steam 10 from the central processing facility 27 to the remote hydrocarbon recovery facility 15 for use during SAGD start-up and/or to supplement steam to the wells.

Still referring to FIG. 2, produced fluids 20 are recovered from the production well 18. The produced fluids 20 can be introduced into a gas-emulsion separator 22 located at the remote hydrocarbon recovery facility 15, resulting in a produced gas 24 and a produced emulsion 26. The produced emulsion 26 can also be referred to as gas-depleted produced fluids. The resulting produced gas 24 can be sent back to a central processing facility 27 for separating light hydrocarbons from unwanted compounds. The resulting produced emulsion 26 can be introduced into a water-hydrocarbon separator 28 located at the remote hydrocarbon recovery facility 15, resulting in produced hydrocarbon-containing component 30 and produced water component 32. The produced hydrocarbon-containing component 30 can be stored at the remote hydrocarbon recovery facility 15 or can be conveyed by pipeline to the central processing facility 27 for further treatment. The produced water component 32 can be used as feedwater 34 for the DFSG 14. Fuel 36 is conveyed to the remote hydrocarbon recovery facility 15 and steam production is enabled when fuel 36 and an oxygen-containing gas 38, such as air, are fed to the DFSG 14. The oxygen-containing gas 38 can be air or an oxygen-enriched mixture suitable for combustion of fuel 36.

Still referring to FIG. 2, makeup water 40 can be added to the feedwater 34. As there is no or very little produced water during SAGD startup operations, the feedwater 34 mainly includes or consists of the makeup water 40. As production from the SAGD operation begins to ramp up, produced water 32 can be obtained from the water-hydrocarbon separator 28 and used as part of the feedwater 34, thereby requiring less makeup water 40. When the SAGD operation reaches a normal operating stage, the feedwater 34 can mainly include produced water 32, with a varying amount of makeup water 40 as required. In some implementations, very little makeup water 40 is required when the SAGD operation reaches a continuous regime. When the reservoir retains water, as is often the case in SAGD start-up, the proportion of makeup water to total feedwater is higher. When more water is recovered from the produced fluids, the proportion of makeup water to total feedwater is lower. Depending on the amount of water recovered from the produced fluids, the proportion of makeup water to total feedwater fed to the DFSG 14 when the SAGD operation reaches a normal operating stage can be between about 0% and about 20%, or between about 0% and about 10%, or even between about 0% and about 5%. The makeup water 40 can be conveyed to the remote hydrocarbon recovery facility 15 from the central treatment facility 27 or can be stored at the remote hydrocarbon recovery facility 15 in a water tank 42 and used directly therefrom as needed. In some scenarios, the reservoir can retain up to about 50% of the injected water early in the SAGD operation, such as at SAGD start-up. In other scenarios, more water is released from the reservoir than is injected. In such cases, no makeup water is needed and the excess water recovered can be stored in water tank 42 or in a separate produced water tank. The excess water can be added to feedwater 34 as needed.

Various implementations of remote steam generation and water separation for reuse as boiler feedwater can provide certain economic advantages, such as (i) using smaller and less expensive lines for conveying the produced hydrocarbon-containing component 30 back to the central processing facility 27, (ii) not using a steam line between the central processing facility 27 and the remote hydrocarbon recovery facility 15, and (iii) in some cases, not using a boiler feedwater pump. In some implementations, the production wells are equipped with subsurface pumps that enable the feedwater to have sufficient pressure to be directly fed to the DFSG 14.

Water Treatment at the Remote Hydrocarbon Recovery Facility

Figure 3:
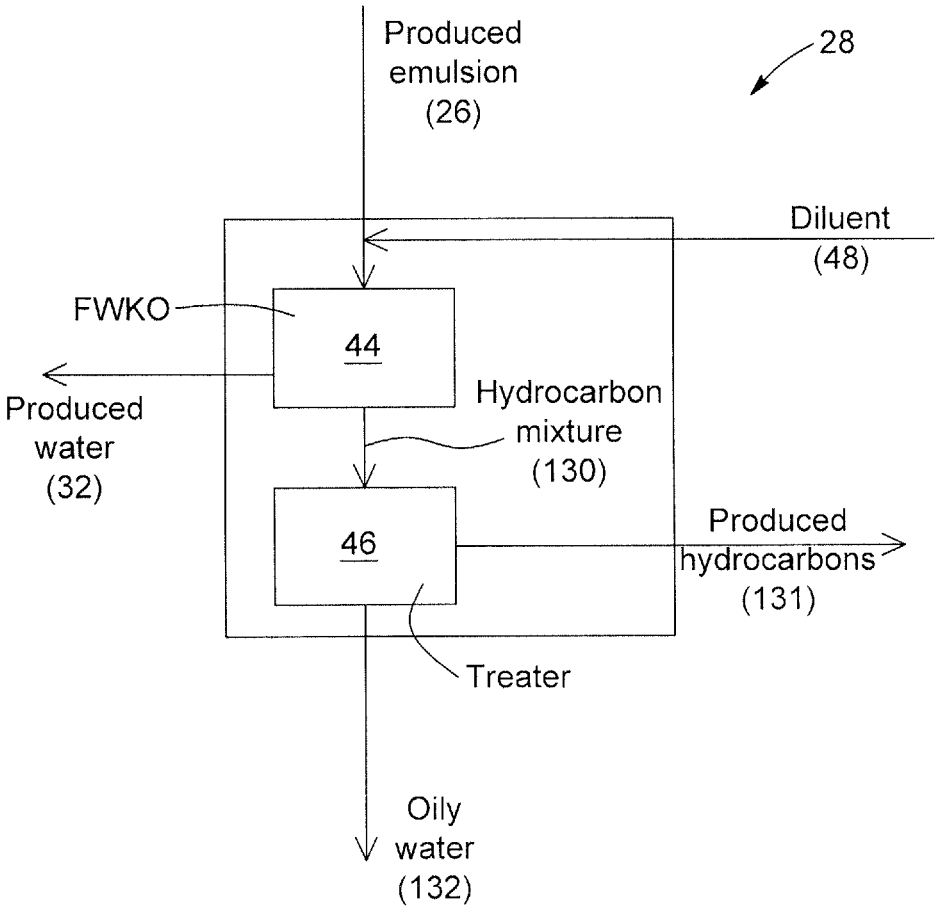
FIG. 3 is a process flow diagram of a water-hydrocarbon separation unit.

Referring to FIG. 3, the water-hydrocarbon separator 28 located proximate to the well pad can include water-hydrocarbon separation components such as a free-water knockout drum (FWKO) 44 and a treater 46. The FWKO 44 separates the produced emulsion into produced water 32 and a hydrocarbon mixture 130. The treater 46 separates the hydrocarbon mixture 130 into produced hydrocarbons 131 and oily water 132. Oily water 132 can be either added to the produced water 32 or further treated in other water-hydrocarbon separation components. To ensure that minimal water reports to the hydrocarbon components and minimal hydrocarbons report to the aqueous phase, the density of the hydrocarbon phase can be adjusted. For adjusting the density of the hydrocarbon phase, a diluent 48 can be added to or upstream of the water-hydrocarbon separator 28, such as upstream of the FWKO 44. In some implementations, the diluent 48 can also be added upstream of the treater 46. The diluent 48 can be conveyed from the central processing facility 27 or can be stored at or near the well pad 16 in a diluent tank. The water-hydrocarbon separation using a diluent is typically conducted at a temperature between about 115° C. and about 155° C., between about 120° C. and about 140° C., or of about 135° C.

It is understood that the produced hydrocarbon-containing component 30 can refer to either the hydrocarbon mixture 130 or the produced hydrocarbons 131. The hydrocarbon mixture 130 refers to a produced hydrocarbon-containing component including and an amount of water. The produced hydrocarbons 131 refer to a produced hydrocarbon-containing component from which water has been substantially removed by at least one water-hydrocarbon separation component such as a treater.

Figure 4:
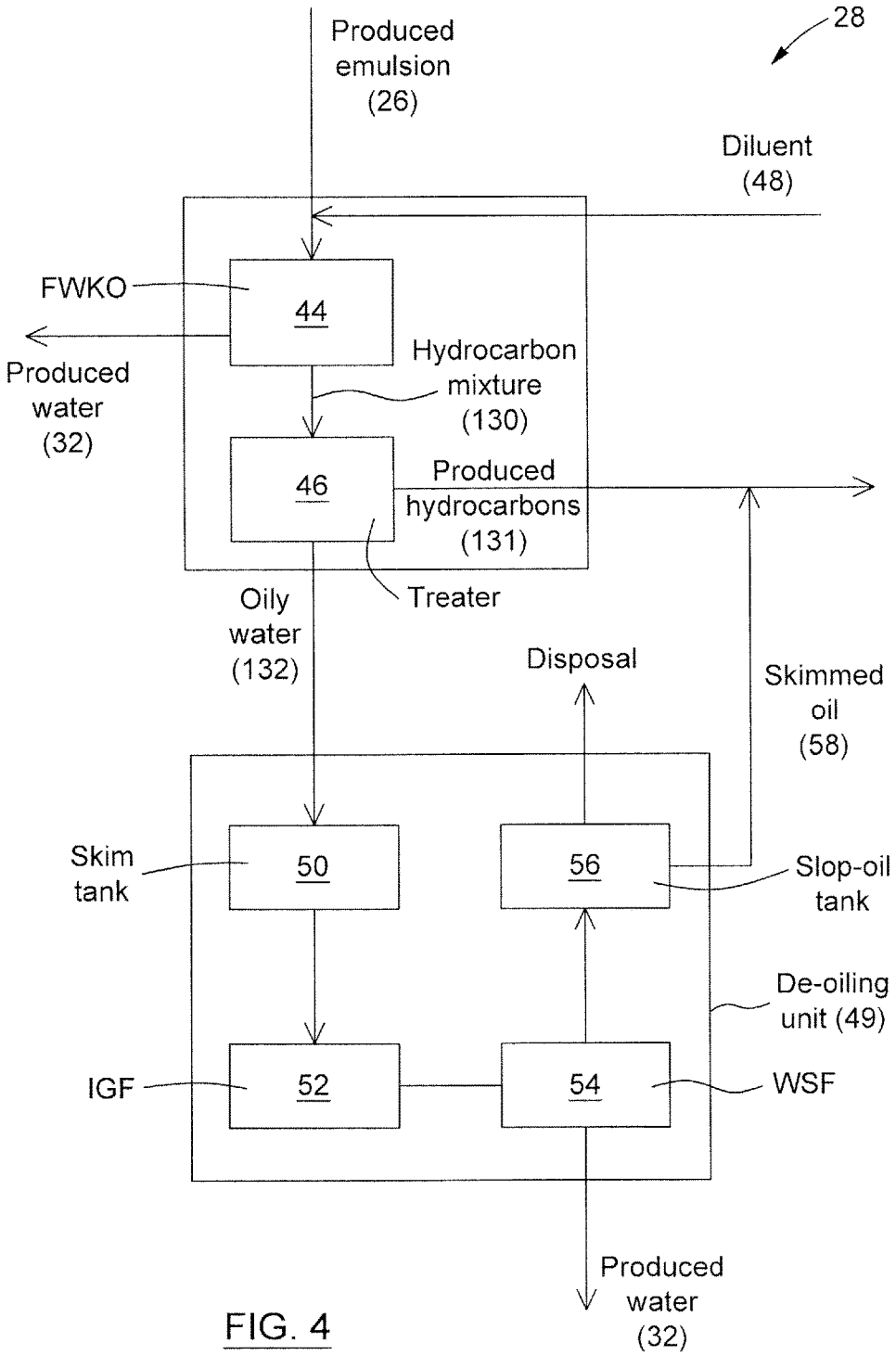
FIG. 4 is process flow diagram of another water-hydrocarbon separation unit.

Referring to FIG. 4, the water-hydrocarbon separator 28 can further include a de-oiling unit 49 for removing additional hydrocarbons from oily water 132 that can be recovered from the treater 46. The de-oiling unit 49 can include at least one of several water-hydrocarbon separating components such as a skim tank 50, a gas assisted floatation unit 52, a walnut shell filtration unit 54 and a slop-oil tank 56.

Figure 6:
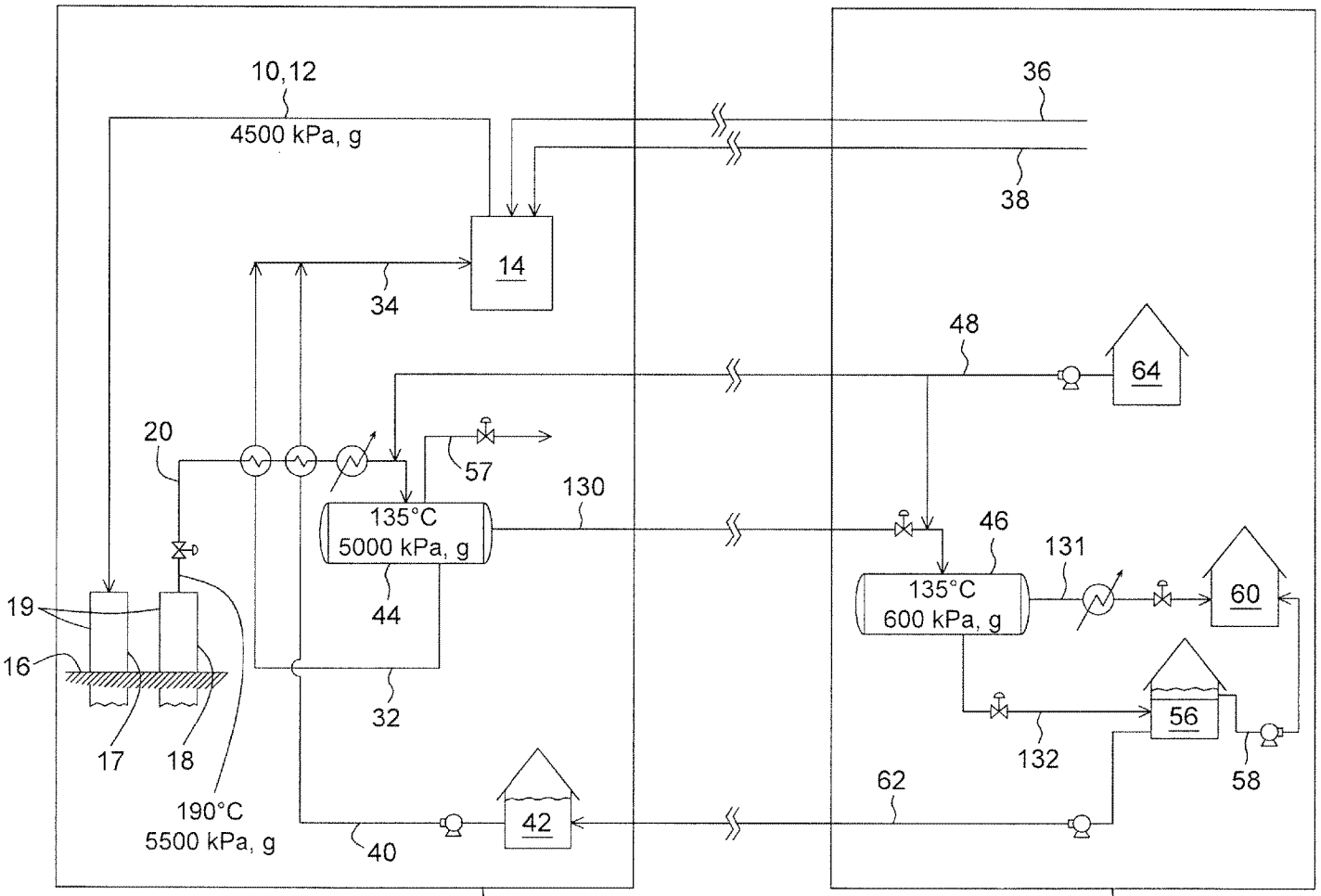
FIG. 6 is a process flow diagram of a SAGD operation with steam generation and partial water recycling at a remote hydrocarbon recovery facility.

Now referring to FIG. 6, the water-hydrocarbon separation step can be split between the remote hydrocarbon recovery facility 15 and the central processing facility 27. In some implementations, a FWKO 44 separates the produced fluids 20 into produced water 32 and a hydrocarbon mixture 130 at the remote hydrocarbon recovery facility 15. It is to be noted that even if the produced water 32 separated by the FWKO 44 contains certain amounts of hydrocarbons, such produced water 32 is still suitable as feedwater for the DFSG 14, because DFSGs can typically operate on lower quality water. In some scenarios, the produced water 32 can contain up to about 1% in weight of hydrocarbons. In other scenarios the produced water 32 can contain up to about 500 ppm of hydrocarbons. The hydrocarbons present in the produced water 32 typically combust upon contacting the flame in the DFSG. The FWKO 44 can also be provided with an outgoing line 57 to evacuate hydrocarbons for flaring.

Still referring to FIG. 6, the concentration of water present in the hydrocarbon mixture 130 can be up to about 10 wt %. The hydrocarbon mixture 130 is conveyed from the remote hydrocarbon recovery facility 15 to a treater 46 located at the central processing facility 27. The treater 46 separates the hydrocarbon mixture 130 into produced hydrocarbons 131 and oily water 132. The oily water 132 is sent to a slop-oil tank 56 where remaining hydrocarbons are skimmed to produce skimmed oil 58. The produced hydrocarbons 131 and the skimmed oil 58 can be stored in a dilbit storage tank 60. Treated water 62 can be recovered from the slop-oil tank 56, conveyed back to the water tank 42 located at the remote hydrocarbon recovery facility 15 and reused as part of the makeup water 40. The diluent 48 is added upstream of the FWKO and can also be added upstream of the treater 46 if needed for better water-oil separation and/or for final product blending. The diluent can be stored in a diluent storage unit 64 located at the central processing facility 27 and/or at the remote hydrocarbon recovery facility 15.

In some implementations, a FWKO is located at the remote hydrocarbon recovery facility 15 while at least one other type of water-hydrocarbon separation component is located at the central processing facility 27 or a separate water treating facility 15. Such water-hydrocarbon separation components can include a treater, a skim tank, a gas assisted floatation unit, a walnut shell filtration unit or a slop-oil tank.

In some implementations, the water-hydrocarbon separator is a high-temperature water-hydrocarbon separator that allows separating water and hydrocarbons at high temperatures between about 210° C. and about 240° C., or between about 220° C. and about 230° C., or of about 225° C., and at pressures between about 2200 kPag and about 2800 kPag, or between about 2300 kPag and about 2700 kPag, or of about 2500 kPag. At such temperatures and pressures, the hydrocarbons (such as bitumen) become sufficiently heavier than water, are separated by gravity and no diluent is added. The hydrocarbons are not diluted for transport, but are kept at a temperature between about 80° C. and about 100° C., or between about 85° C. and about 95° C., or of about 90° C. In such cases, the pipeline conveying the hydrocarbons back to the central processing facility 27 is designed and built to keep the temperature high.

Injection of a Steam-$CO_2$ Mixture into the Injection Well

Figure 5:
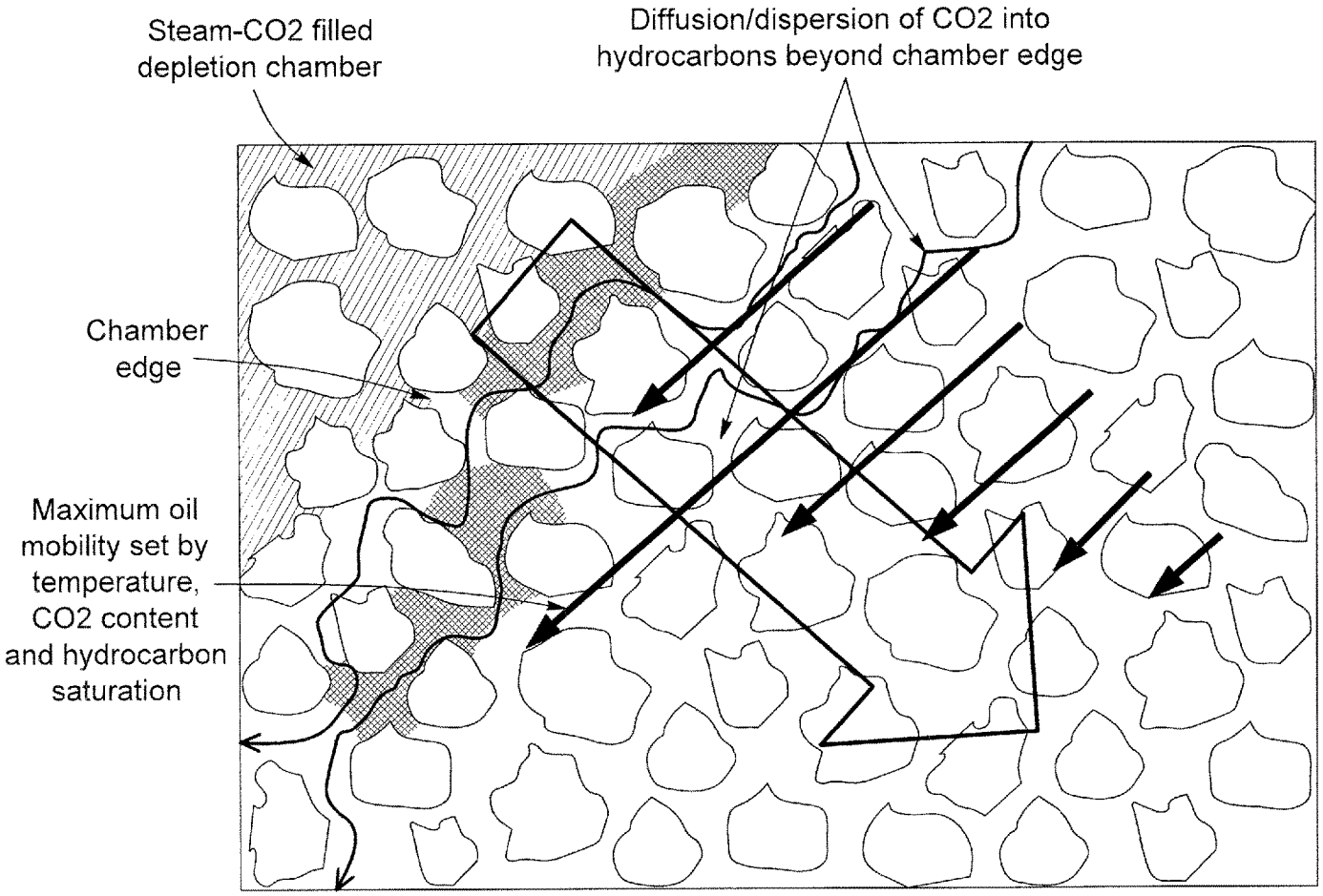
FIG. 5 is a schematic diagram of the effects of $CO_2$ co-injection in the reservoir.

Referring to FIGS. 5 and 14, the basis of a typical SAGD process is that the injected steam forms a steam chamber that grows upwardly from the well pair in the formation. The heat from the steam reduces the viscosity of the hydrocarbons which flow downward toward the lower well, whereas the steam and gases rise because of their lower density. This results in the steam and gases filling the steam chamber and depleting the chamber of hydrocarbons. The steam chamber can also be referred to as a "depletion chamber" in this context.

In the case of co-injection of steam and $CO_2$ in the injection well, such as when DFSGs are used for steam generation, the $CO_2$ can diffuse and disperse into the hydrocarbons beyond the edge of the depletion chamber. The $CO_2$ is soluble in the hydrocarbon phase, and higher $CO_2$ contents in the hydrocarbon phase lower the hydrocarbon phase viscosity. The presence of $CO_2$ in the vapour phase compensates for the lower steam partial pressure and temperature.

Implementations with Multiple DFSGs

In some implementations, the remote steam generators include multiple DFSGs that are located at each remote hydrocarbon recovery facility. Providing multiple DFSGs at a single remote hydrocarbon recovery facility can facilitate operational flexibility and easier maintenance. For example, in the event the recycled produced water used as feedwater contains high levels of contaminants and impurities (such as residual hydrocarbons, inorganic compounds or suspended solids), fouling can occur in the DFSGs. Fouling can lead to maintenance, in which case one DFSG can be taken off line for maintenance while the other DFSG(s) located at the same remote hydrocarbon recovery facility maintains the required rate of steam injection.

Figure 7:
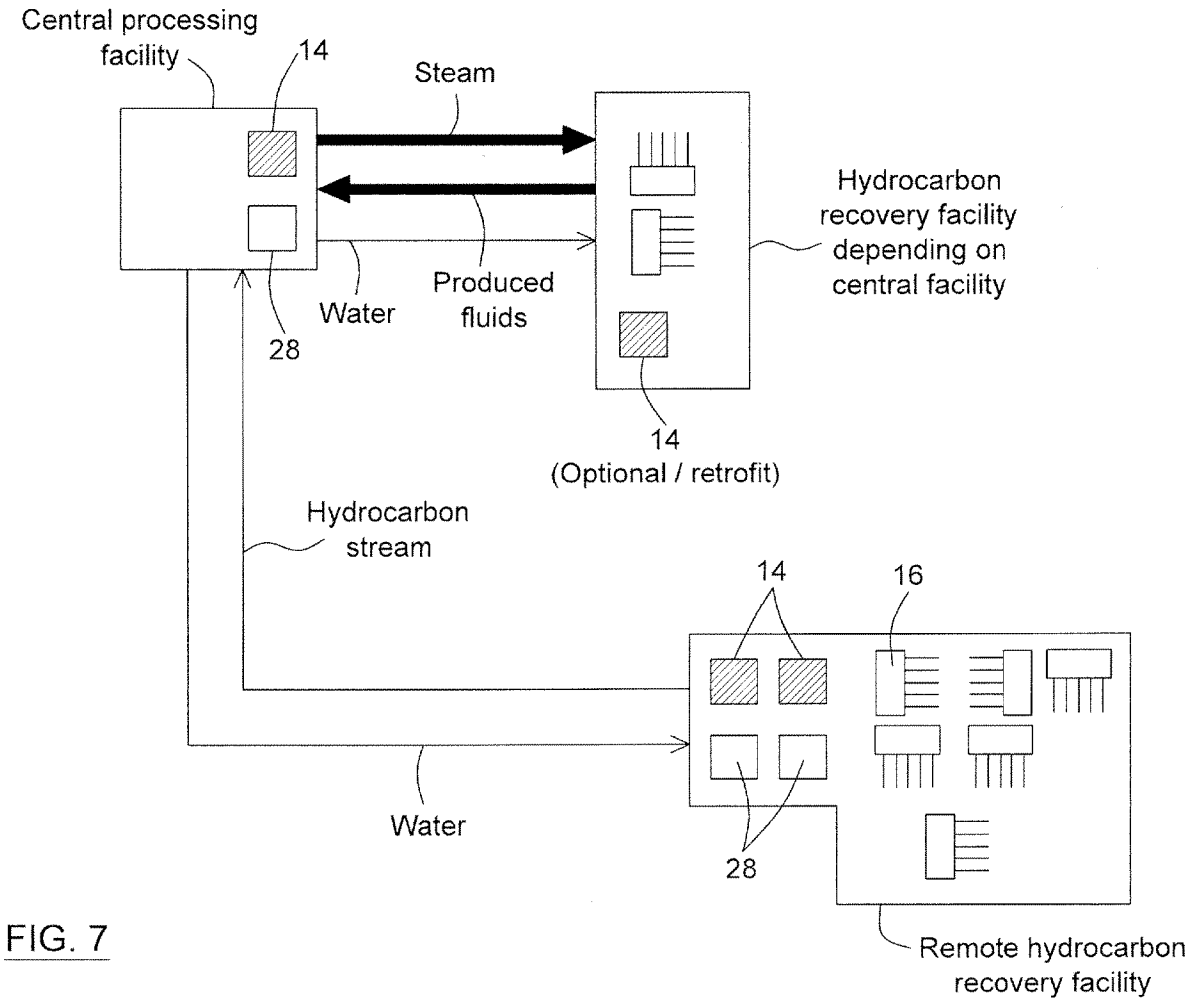
FIG. 7 is a top view schematic of a SAGD system with steam generation and water recycling at remote hydrocarbon recovery facilities, as well as steam generation at a central processing facility.

Now referring to FIG. 7, in some implementations, DFSGs can be installed in order to retrofit an existing remote hydrocarbon recovery facility previously supported exclusively by a central processing facility. The new DFSGs can replace the steam supplied from the central processing facility or provide additional steam, as well as combustion gas, for the remote hydrocarbon recovery facility. For example, as new well pairs are brought on line, DFSGs can be installed to provide steam supply in addition to the existing steam supplied from the central facility. In addition, in the case of dual steam supply from a central processing facility and remote DFSGs, the different steam supplies can be used for different wells depending on steam and $CO_2$ injection demands.

In addition, it should be noted that by preceding an element with the indefinite article "a", it should be understood that one or several elements can be used. For example, one or several DFSGs, gas-emulsion separators, water-hydrocarbon separators, well pads, Injection wells or production wells can be used at each remote hydrocarbon recovery facility.

SIMULATION EXAMPLES

Example 1

Figure 8:
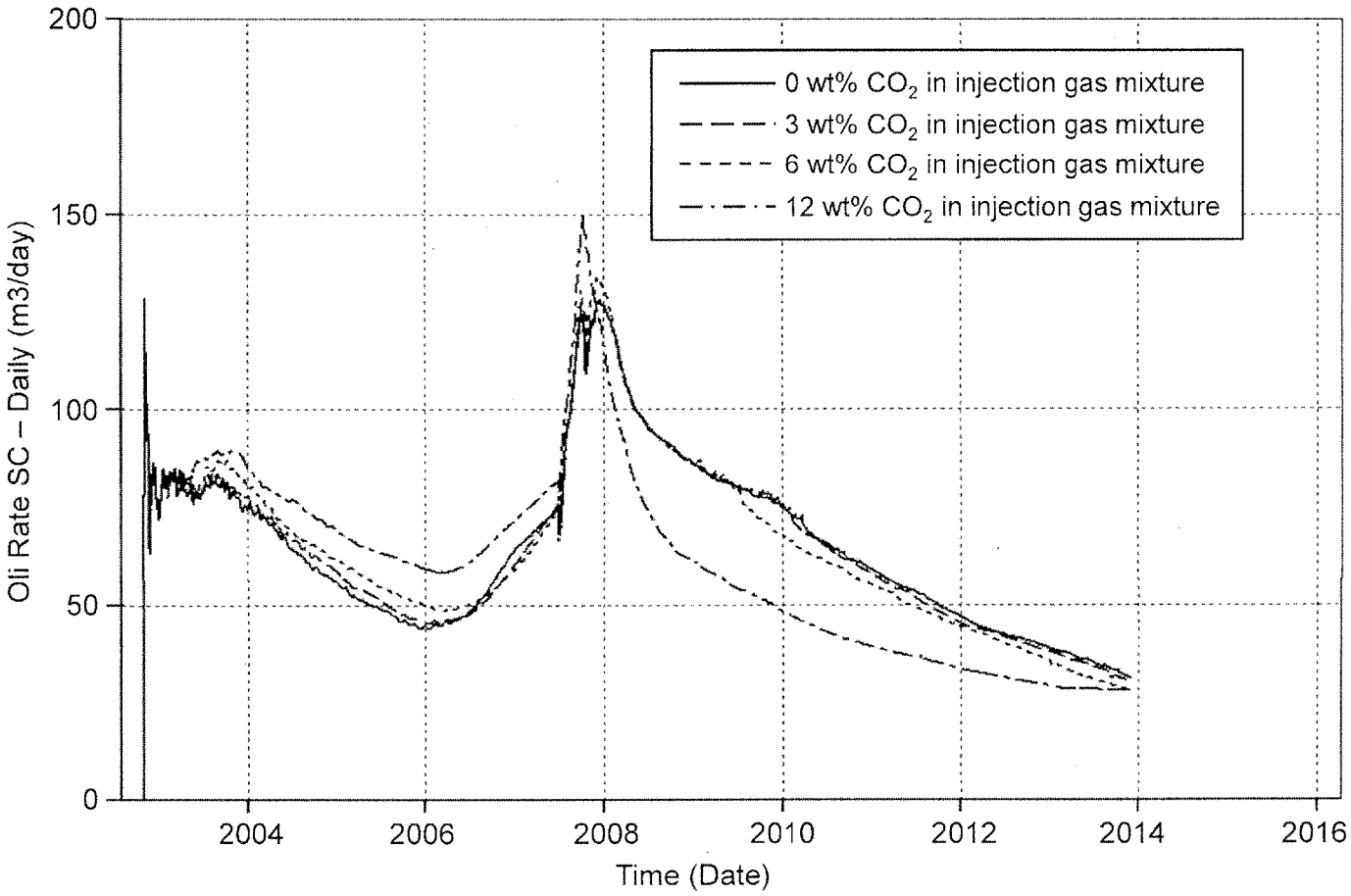
FIG. 8 is a graph of oil rate versus time for different $CO_2$ concentrations.
Figure 9:
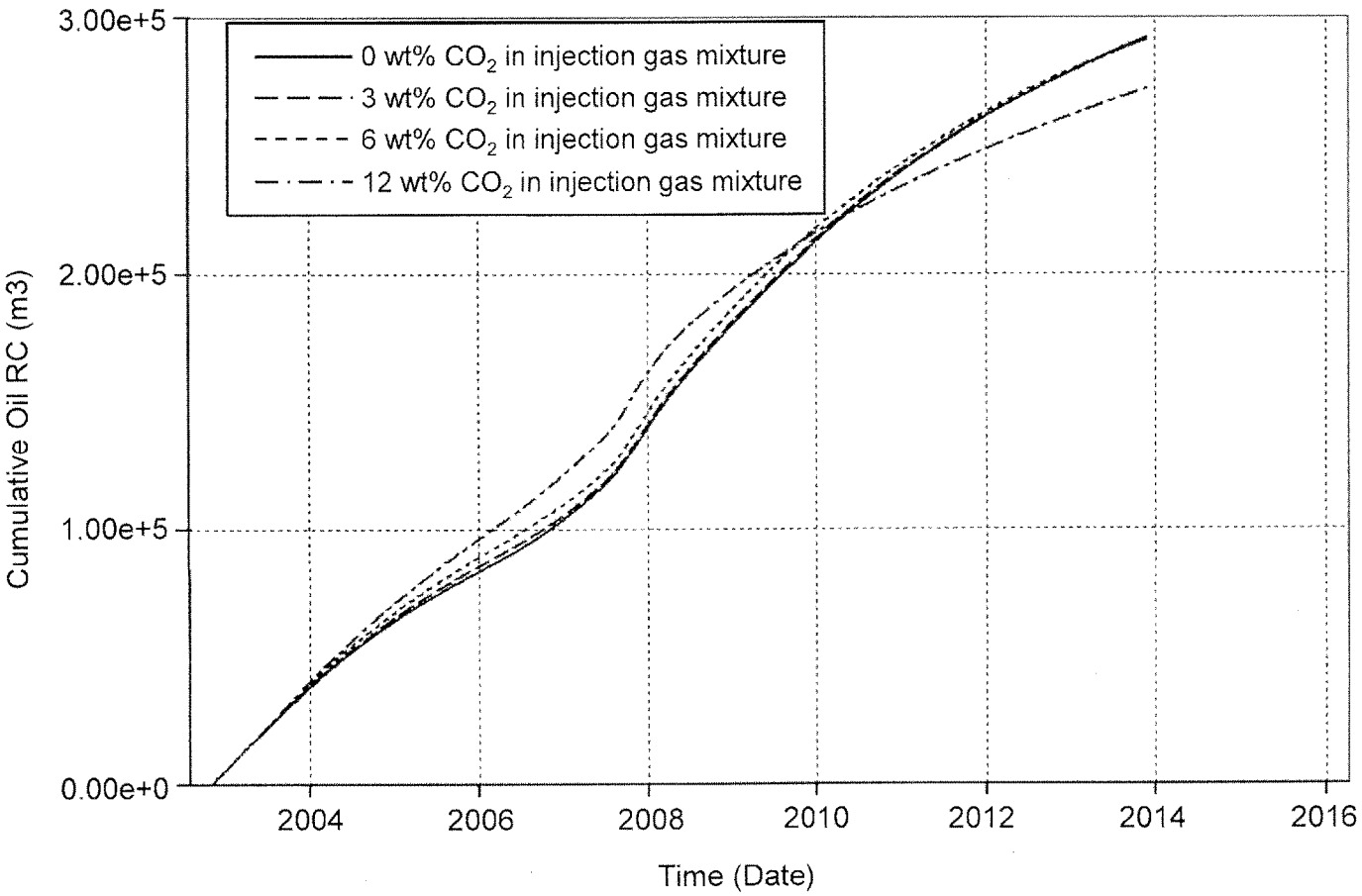
FIG. 9 is a graph of cumulative oil versus time for different $CO_2$ concentrations.
Figure 10:
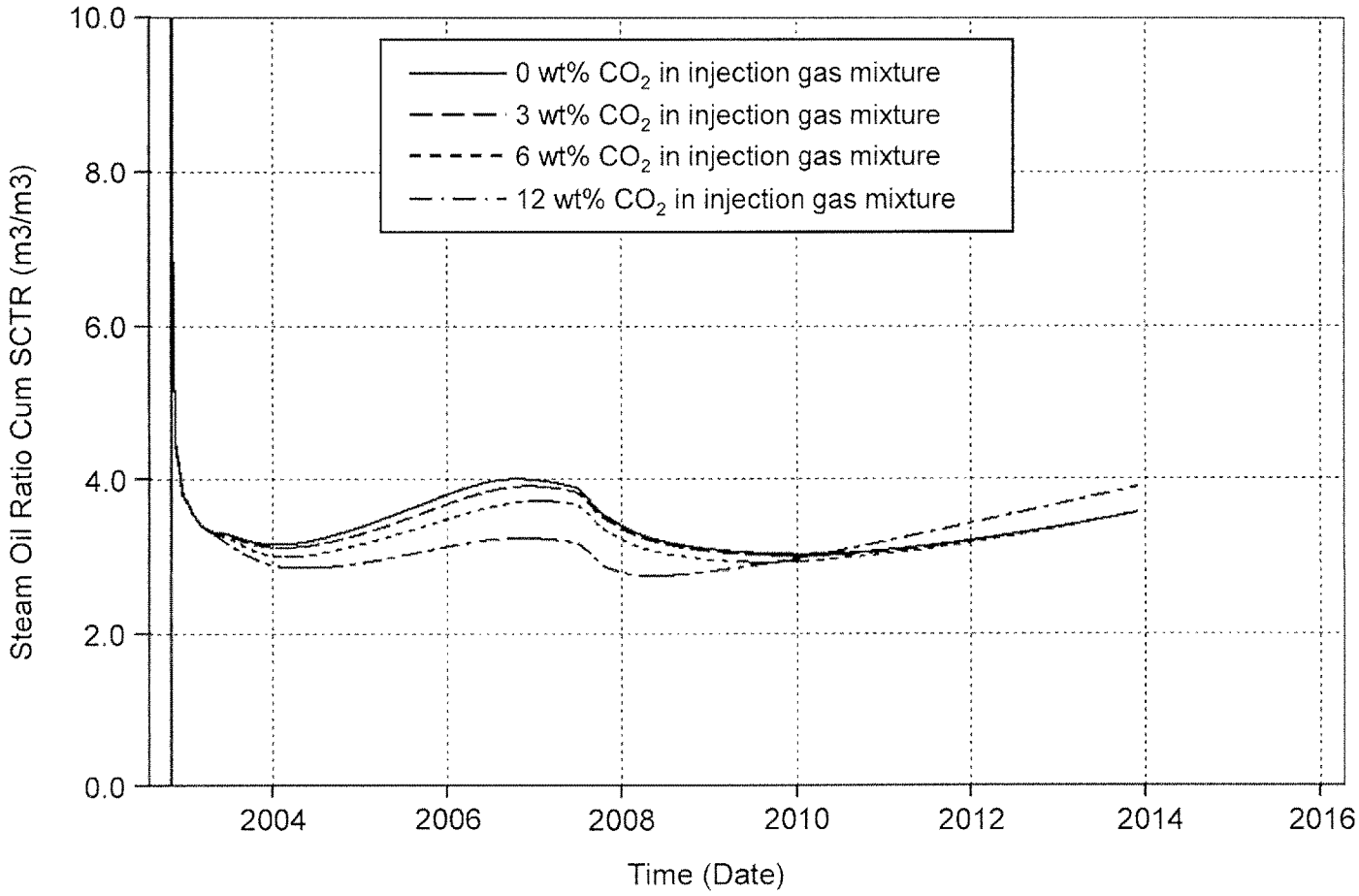
FIG. 10 is a graph of steam-to-oil ratio (SOR) versus time for different $CO_2$ concentrations.

Referring to FIGS. 8 to 10, the impact of $CO_2$ percentage on oil rate, cumulative oil production and steam-to-oil ratio (SOR) can be observed.

Simulations were performed with the following operating strategy: a maximum producer rate of 300 $m^3$/day and an initial steam-$CO_2$ gas injection pressure set at about 1500 kPa for about 4.5 years and at about 1000 kPa thereafter. The $CO_2$ content of the gas was set at 0%, 3%, 6% or 12%. The model also took into account geology; oil, gas and water properties; fluid viscosities, well locations and properties.

Table 1 shows simulation results of the amount of $CO_2$ stored in a reservoir as a function of the $CO_2$ fraction in the injected steam-$CO_2$ gas mixture.

TABLE 1

| $CO_2$ fraction in steam | | |
|---|---|---|
| 3 wt. % | 6 wt. % | 12 wt. % |
| 94% of $CO_2$ stored | 94% of $CO_2$ stored | 92% of $CO_2$ stored |

These results show that a high proportion of $CO_2$ can be stored in the reservoir. At $CO_2$ fractions of 3% and 6%, the proportion of $CO_2$ stored in the reservoir remains constant, while at 12% the storage percentage decreases by 2%.

Example 2

Figure 11:
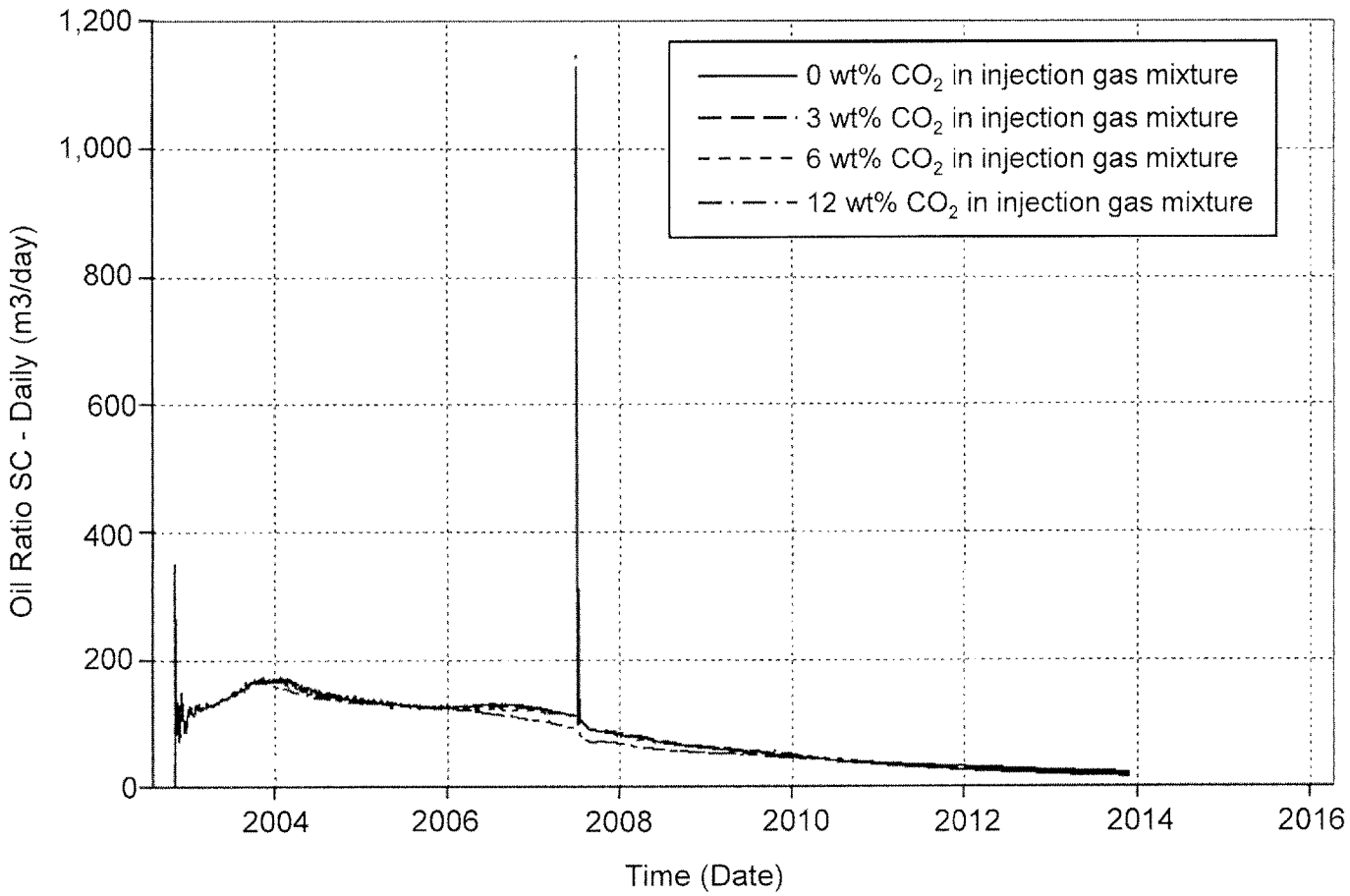
FIG. 11 is another graph of oil rate versus time for different $CO_2$ concentrations.
Figure 12:
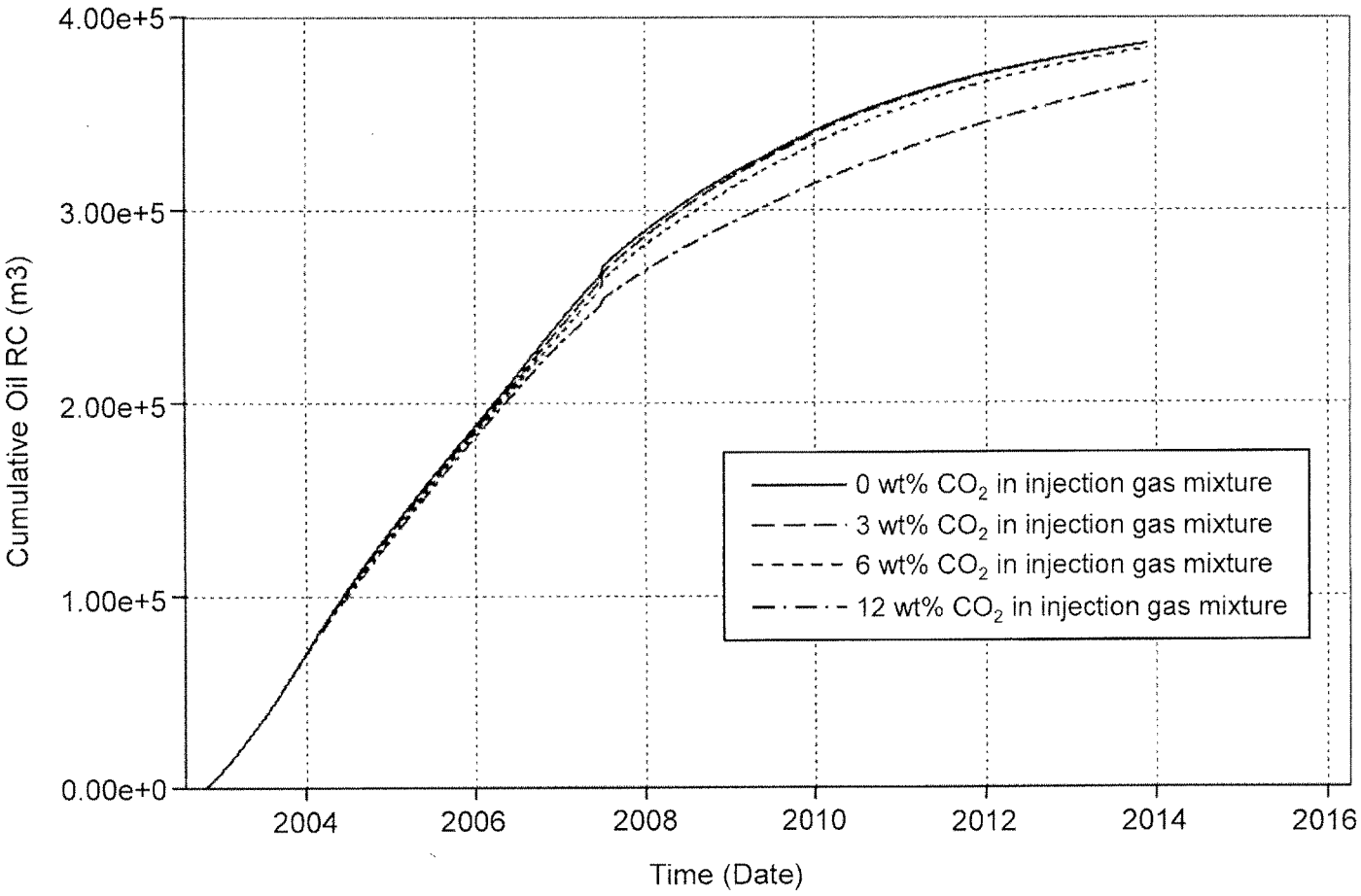
FIG. 12 is another graph of cumulative oil versus time for different $CO_2$ concentrations.
Figure 13:
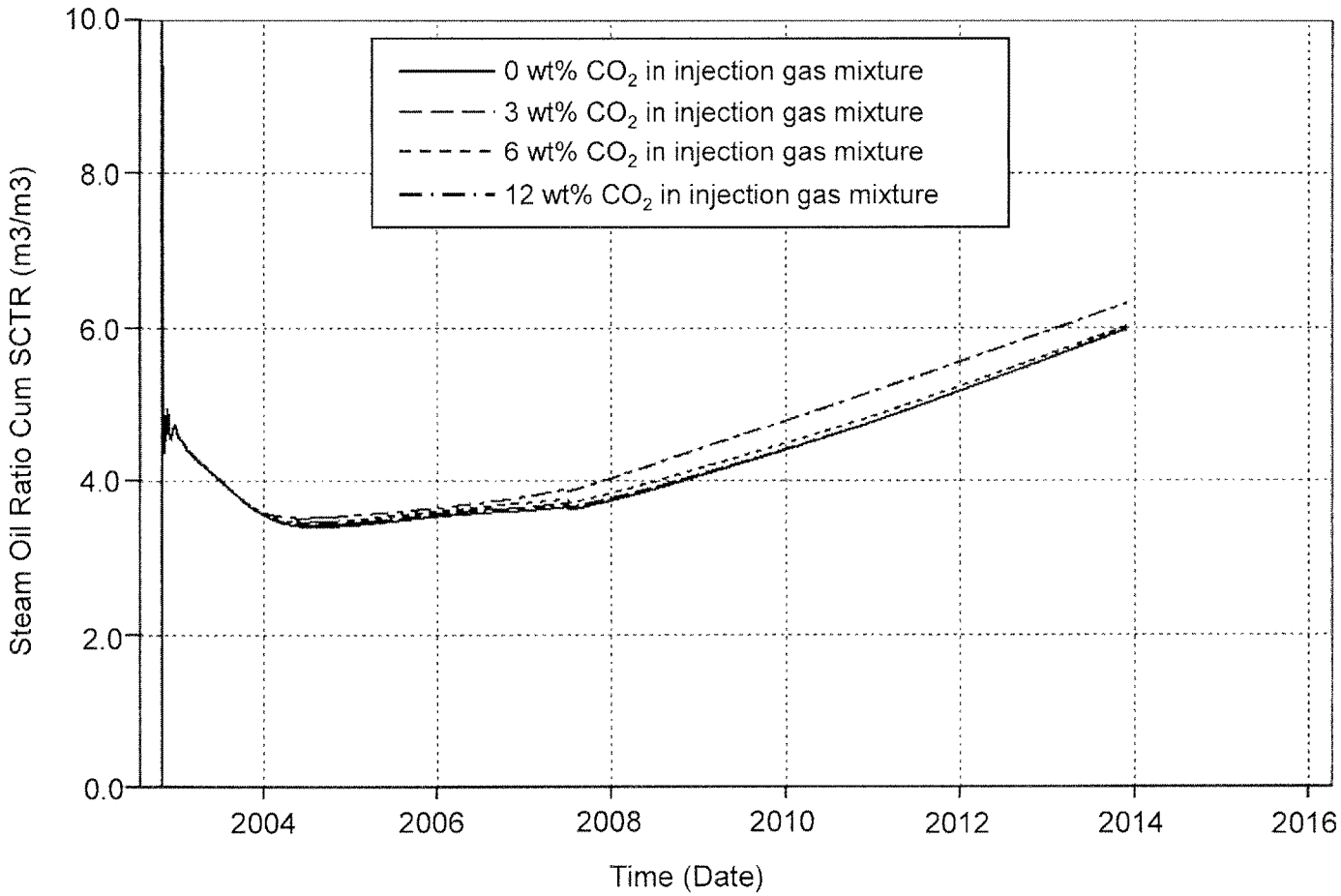
FIG. 13 is another graph of steam-to-oil ratio (SOR) versus time for different $CO_2$ concentrations.

Referring to FIGS. 11 to 13, the impact of $CO_2$ percentage on oil rate, cumulative oil production and steam-to-oil ratio (SOR) can be observed.

Simulations were performed with the following operating strategy: a maximum steam rate of 500 $m^3$/day and a producer pressure of about 1500 kPa for about 4.5 years and of about 1000 kPa thereafter. The $CO_2$ content of the gas was set at 0%, 3%, 6% or 12%. The model also takes into account geology; oil, gas and water properties; fluid viscosities, well locations and properties.

Table 2 shows simulation results of the amount of $CO_2$ stored in a reservoir as a function of the $CO_2$ fraction in the steam.

TABLE 2

| $CO_2$ fraction in steam | | |
|---|---|---|
| 3 wt. % | 6 wt. % | 12 wt. % |
| 89% of $CO_2$ stored | 89% of $CO_2$ stored | 88% of $CO_2$ stored |

These results show that a high proportion of $CO_2$ can be stored in the reservoir. At $CO_2$ fractions of 3% and 6%, the proportion of $CO_2$ stored in the reservoir remains constant, while at 12% the storage percentage decreases by 1%.

The invention claimed is:

1. A system for recovering hydrocarbons from a reservoir, the system comprising:

a processing facility comprising a first water-hydrocarbon separator; and a remote hydrocarbon recovery facility connected to the processing facility by a supply line, the remote hydrocarbon recovery facility comprising:

a steam generator for receiving feedwater and generating a steam-based mixture therefrom, wherein the steam generator comprises a Direct-Contact Steam Generator (DCSG);

a well pad supporting a well pair comprising:

an injection well in fluid communication with the steam generator to receive the steam-based mixture; and a production well for recovering produced fluids from the reservoir; and a second water-hydrocarbon separator in fluid communication with the production well to receive the produced fluids and produce a produced water component and a hydrocarbon mixture comprising an amount of water, the supply line providing fluid communication between the first water-hydrocarbon separator and the second water-hydrocarbon separator to transport the hydrocarbon mixture to the processing facility without transporting the produced water component, the first water-hydrocarbon separator separating the hydrocarbon mixture into treated water and produced hydrocarbons.

2. The system of claim 1, wherein the DCSG is a Direct-Fired Steam Generator (DFSG).

3. The system of claim 1, further comprising:

a fuel line for supplying fuel from the processing facility to the steam generator.

4. The system of claim 1, further comprising:

an oxygen supply assembly for supplying an oxygen-containing gas to the steam generator for combustion.

5. The system of claim 1, wherein the amount of water in the hydrocarbon mixture is up to about 10 wt %.

6. The system of claim 1, further comprising:

a second recycle line for conveying at least a portion of the treated water back to the remote hydrocarbon recovery facility to recycle at least a portion of the treated water as part of the feedwater to the steam generator.

7. The system of claim 1, further comprising:

a gas-emulsion separator in fluid communication with the production well to receive the produced fluids and produce a produced gas and gas-depleted produced fluids, the second water-hydrocarbon separator being configured to receive the gas-depleted produced fluids to produce the produced water component and the hydrocarbon mixture.

8. The system of claim 7, further comprising a produced gas line for transporting the produced gas from the gas-emulsion separator to the processing facility.

9. The system of claim 1, wherein the second water-hydrocarbon separator comprises a free water knockout drum.

10. The system of claim 9, wherein the first water-hydrocarbon separator comprises a treater.

11. The system of claim 9, wherein the water-hydrocarbon separator further comprises a skim tank.

12. The system of claim 9, wherein the water-hydrocarbon separator further comprises an induced floatation unit.

13. The system of claim 9, wherein the water-hydrocarbon separator further comprises a walnut shell filtering unit.

14. The system of claim 9, wherein the water-hydrocarbon separator further comprises a slop-oil tank.

15. The system of claim 1, further comprising:

a diluent line to supply a diluent to the produced fluids to produce diluted produced fluids that are separated in the second water-hydrocarbon separator.

16. The system of claim 15, wherein the diluent line is connected upstream of the water-hydrocarbon separator.

17. The system of claim 15, wherein the diluent line is in fluid communication with the processing facility to receive the diluent therefrom.

18. The system of claim 15, wherein the diluent line is in fluid communication with a diluent tank or diluent truck located at the remote hydrocarbon recovery facility.

19. The system of claim 1, further comprising:

a water recycle line for recycling at least a portion of the produced water component from the second water-hydrocarbon separator as at least part of the feedwater received by the DCSG.

20. The system of claim 19, wherein recycling at least a portion of the produced water component comprises recycling all of the produced water component.

21. The system of claim 19, wherein the feedwater further comprises makeup water.

22. The system of claim 21, wherein the makeup water is at least partially obtained from the processing facility.

23. The system of claim 21, wherein the concentration of the makeup water in the feedwater is about 0 wt% to about 90 wt%.

24. The system of claim 21, wherein the concentration of the makeup water in the feedwater is about 0 wt% to about 20 wt%.

25. The system of claim 21, further comprising:

a makeup water line for supplying the makeup water to the steam generator from a water source.

26. The system of claim 25, wherein the water source comprises a water tank located at the remote hydrocarbon recovery facility.

27. The system of claim 1, wherein the hydrocarbons are recovered from the reservoir by Steam-Assisted Gravity Drainage (SAGD).

28. The system of claim 7, wherein the injection well is a SAGD injection well and the production well is a SAGD production well underlying the SAGD injection well.

29. The system of claim 27, wherein the steam-based mixture comprises a steam-$CO_2$ mixture that includes steam and combustion gases produced by the DCSG.

30. The system of claim 29, wherein the steam-$CO_2$ mixture comprises between about 1 wt. % and about 12 wt. % of $CO_2$.

31. The system of claim 1, wherein the steam generator of the remote hydrocarbon recovery facility consists of a DCSG.

32. The system of claim 31, comprising a feedwater supply line in fluid communication between the DCSG and the second water-hydrocarbon separator, and configured to supply all of the produced water component to the DCSG.

33. The system of claim 31, comprising a plurality of the remote hydrocarbon recovery facilities being connected to the processing facility by respective supply lines to supply respective hydrocarbon mixtures to the processing facility.

34. The system of claim 31, wherein the steam generator and the second water-hydrocarbon separator are located within 200 meters of the well pad, and the processing facility is located multiple kilometers away from the remote hydrocarbon recovery facility.

35. The system of claim 34, wherein the steam generator and the second water-hydrocarbon separator are located on the well pad.

* * * * *